US006450106B2

(12) United States Patent
McIntyre

(10) Patent No.: US 6,450,106 B2
(45) Date of Patent: Sep. 17, 2002

(54) PORTABLE DISPLAY ASSEMBLY

(76) Inventor: Jonothon M. W. McIntyre, 303 East Ave. R-7, Palmdale, CA (US) 93550

( * ) Notice: Subject to any disclaimer, the term of this patent is extended or adjusted under 35 U.S.C. 154(b) by 0 days.

(21) Appl. No.: 09/801,251

(22) Filed: Mar. 7, 2001

Related U.S. Application Data

(60) Provisional application No. 60/187,801, filed on Mar. 8, 2000.

(51) Int. Cl.[7] ..... A47B 85/00
(52) U.S. Cl. ..... 108/92; 108/23
(58) Field of Search ..... 108/23, 92, 94, 108/95, 93, 49; 248/129, 131, 145, 145.6, 148, 150, 153, 158, 415, 157, 175

(56) References Cited

U.S. PATENT DOCUMENTS 205,670 A * 7/1878 Murdock
1,401,057 A * 12/1921 Elliot
1,928,151 A * 9/1933 Goldman
1,933,673 A * 11/1933 Krajnc
3,212,748 A * 10/1965 Faurot
3,789,778 A * 2/1974 Brand
4,488,497 A * 12/1984 Bevans
4,938,364 A * 7/1990 Stadelman et al.
5,979,337 A * 11/1999 Clark et al.
6,203,053 B1 * 3/2001 Sohrt et al.

FOREIGN PATENT DOCUMENTS

JP 11-115764 * 4/1999

* cited by examiner

*Primary Examiner*—Jose V. Chen
(74) *Attorney, Agent, or Firm*—Scott W. Kelley; Kelly Bauersfeld Lowry & Kelley LLP

(57) ABSTRACT

A portable display assembly is disclosed including an elongated, curved S-shaped frame having handles extending therefrom. A pair of wheels are operably disposed on an axle attached to a lower end of the frame, and two prongs extend from the lower end of the frame to cooperatively form a supportive base. A plurality of shelves are connected to the frame such that they are capable of being selectively swivelled from one position to another. A lamp extends from an upper end of the frame, and has a pivoting section to enable the lamp to be selectively directed over portions of the assembly. In one form, the frame includes a plurality of interconnecting modular tube segments connected to one another, the shelves are removably connected to the frame, and the lamp is removably attached to the upper end of the frame so that the assembly can be broken down for storage.

24 Claims, 10 Drawing Sheets

PORTABLE DISPLAY ASSEMBLY

RELATED APPLICATION

This application claims priority from provisional application Serial No. 60/187,801, filed Mar. 8, 2000.

BACKGROUND OF THE INVENTION

The present invention relates to display assemblies. More particularly, the present invention relates to a display assembly which is designed to support and display plants and which is portable and modular.

Plants, such as ferns, ivies, etc., are often placed indoors or on the patio and serve to purify the air and enhance the aesthetics of the surrounding area. Plants are typically placed on existing furniture such as bookshelves, end tables, counters, desks, etc. Outdoors, the plants may be placed on steps or hung from eves or other overhangs. The plants are often kept in pots, some of which may be very ornate. Sometimes, these potted plants are stored on stands which serve to support a plant at an elevated level.

However, the present manner of storing and displaying plants is lacking in several aspects. Placing plants on existing furniture takes up valuable furniture space. Water and other plant material can escape from the pot and create a mess surrounding the plant and even damage the underlying furniture. Existing plant stands are often not aesthetically pleasing but typically only serve to support one plant at a predetermined elevation. There are circumstances which require that the plants be moved from one location to another, such as moving the plants from outdoors to indoors or from room to room. Oftentimes gardeners move outdoor plants to rearrange the placement of the plants or to plant them in the ground. Existing plant stands or furniture used to support plants are sometimes large and awkward and not easily moved from one location to another. Existing methods of storing and displaying plants also fail to provide the best environment for the plant with respect to lighting. When not in use, such plant stands require significant storage space.

Caterers often use carts or other portable assemblies to offer beverages, food, appetizers, etc. While often functional, these carts and assemblies lack aesthetic appeal. Also, the carts may lack adequate lighting and are unwieldy to transport and store. Within one's home, such a catering cart it typically unavailable. Thus, when hosting a party or the like, food, appetizers and drinks are typically placed on tables, counters, coffee tables, end tables, etc.

Accordingly, there is a need for a display assembly which is mobile so as to be moved from one location to another with ease. The assembly should also be capable of being broken down into individual components when not in use. Such an assembly should also be aesthetically pleasing to the eye and usable indoors as well as outdoors. Such an assembly should also be specifically designed to store and display plants, while providing a beneficial environment for the plants. Such an assembly should be capable of supporting multiple plants at once while remaining aesthetically pleasing. The present invention fulfills these needs and provides other related advantages.

SUMMARY OF THE INVENTION

The present invention relates to a portable display assembly which is usable indoors as well as outdoors, is aesthetically pleasing to the eye and can be specifically designed to beneficially store and display plants.

The display assembly includes an elongated and curved frame having handles extending therefrom. Preferably, the frame is comprised of tubing having a generally S-shaped configuration. In a particularly preferred embodiment, the frame comprises interconnecting modular tube segments connected to one another so as to be capable of being broken down for storage when not in use.

A pair of wheels are operably disposed on an axle attached to a lower end of the frame so that the display assembly can be easily moved from one location to another. Two prongs extend from the lower end of the frame to cooperatively form a base with the lower end of the frame such that the display assembly is stable when resting.

A plurality of shelves are connected to the assembly along the length of the frame. In a particularly preferred embodiment, the shelves are removably connected to the frame. The shelves are connected to the frame such that they are capable of being selectively swivelled from one position to another. Typically the shelves are of varying sizes. The shelves may include a mesh base so as to make the assembly lighter in weight, while allowing debris to fall therethrough. Preferably the shelves also include hooks which are configured to support hanging articles from the shelves. When the portable display assembly is designed specifically to act as a portable plant display assembly, the shelves are configured in an ornamental lotus leaf design so as to blend in with the plants placed thereon.

A lamp extends from an upper end of the frame. The lamp includes a pivoting section to enable the lamp to be selectively directed over portions of the assembly. In a particularly preferred embodiment, the lamp is removably attached to the upper end of the frame.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
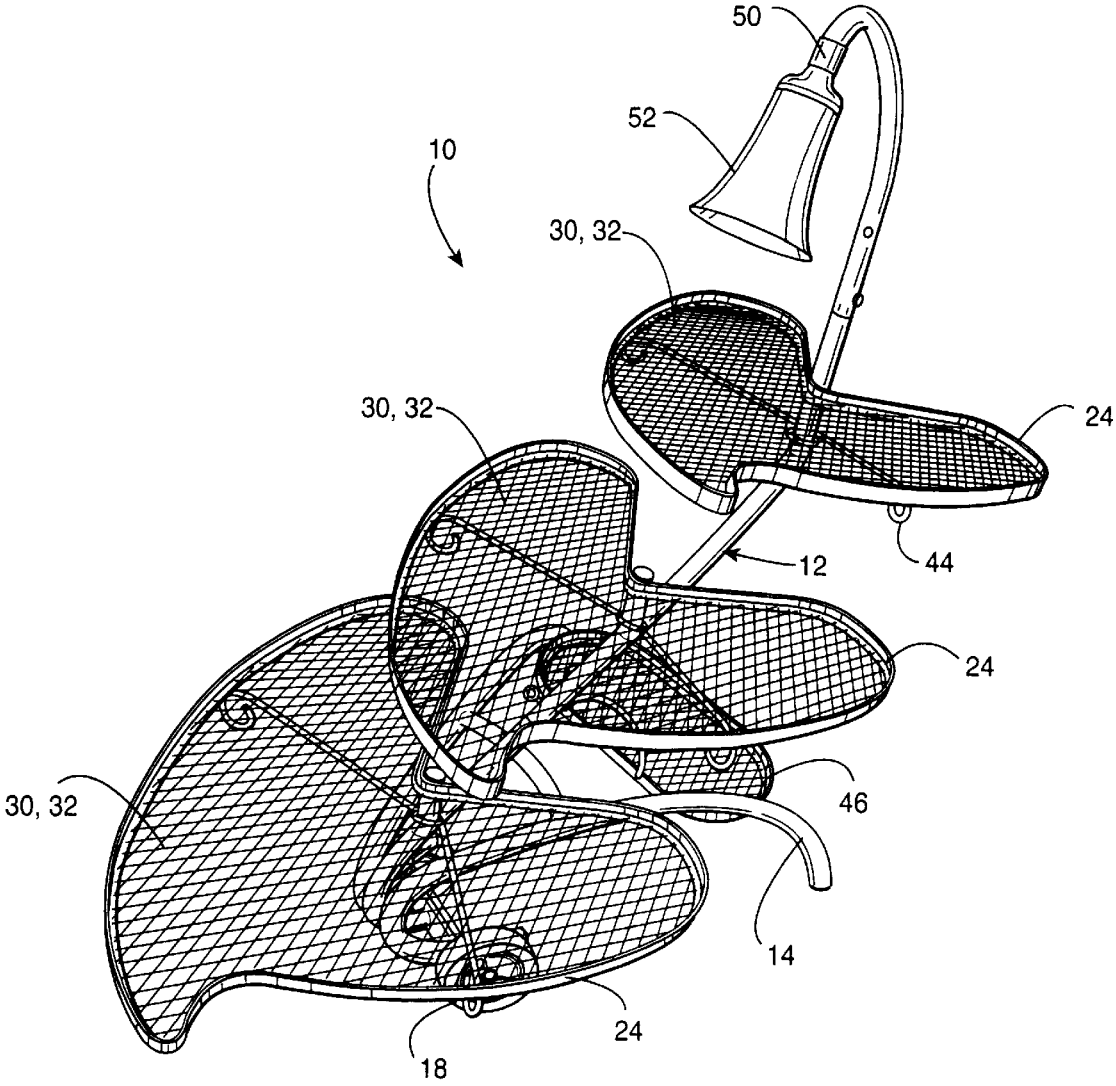
FIG. 1 is a perspective view of a portable display assembly embodying the present invention and having mesh shelves.

As shown in the drawings for purposes of illustration, the present invention is concerned with a portable display assembly, generally referred to by the reference number 10 in the accompanying drawings. The display assembly 10 can be used for a variety of purposes, including a catering cart or general display, but is particularly adapted for use as a portable plant display.

Figure 4:
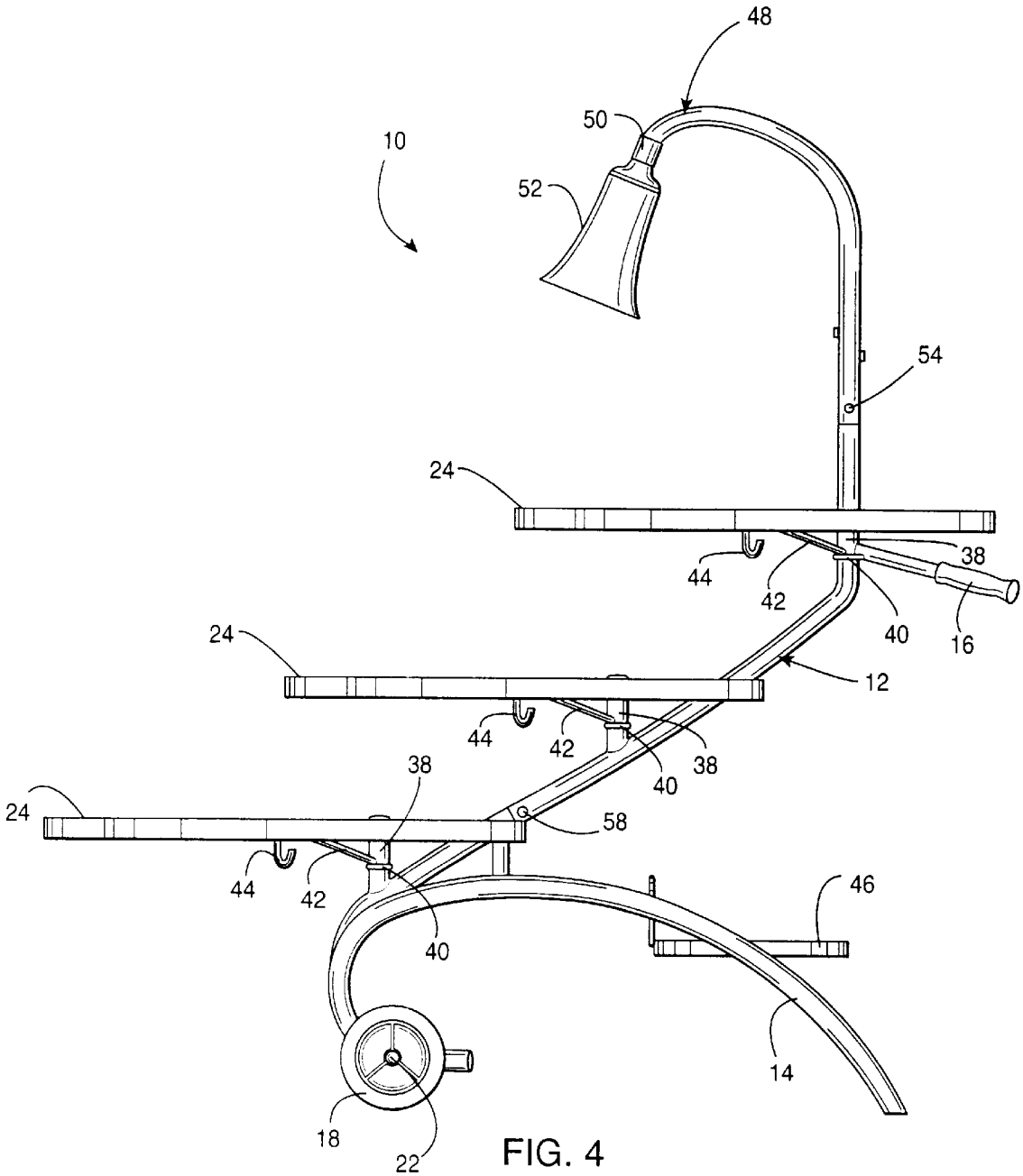
FIG. 4 is a side elevational view of the assembly of FIG. 1.
Figure 5:
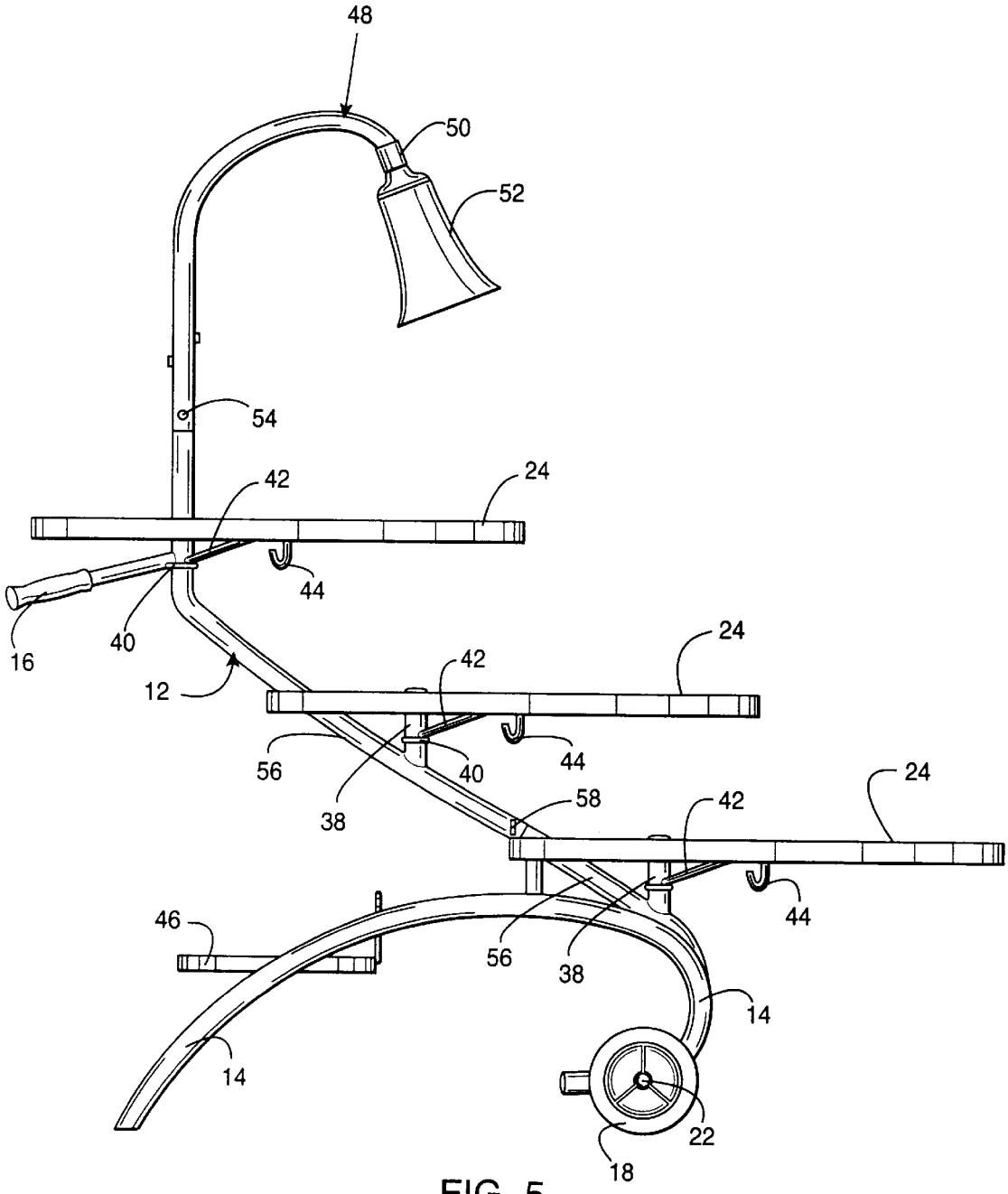
FIG. 5 is an opposite side view of the assembly of FIG. 1.
Figure 6:
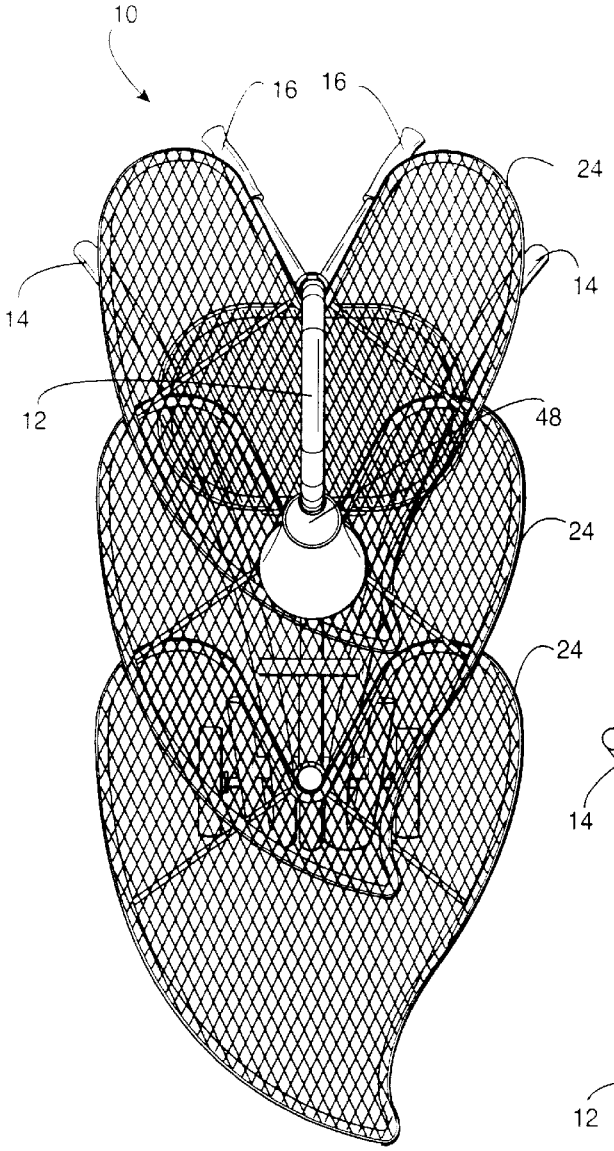
FIG. 6 is a top view of the assembly of FIG. 1.

The assembly 10 includes an elongated and curved frame 12 which is preferably comprised of a durable hollow tubing, such as metal tubing so as to be lightweight and strong. The frame 12 generally has an S-shaped configuration, as best seen in the side elevational views of FIGS. 4 and 5, so as to imitate the vine or tendril nature of many plants.

Figure 2:
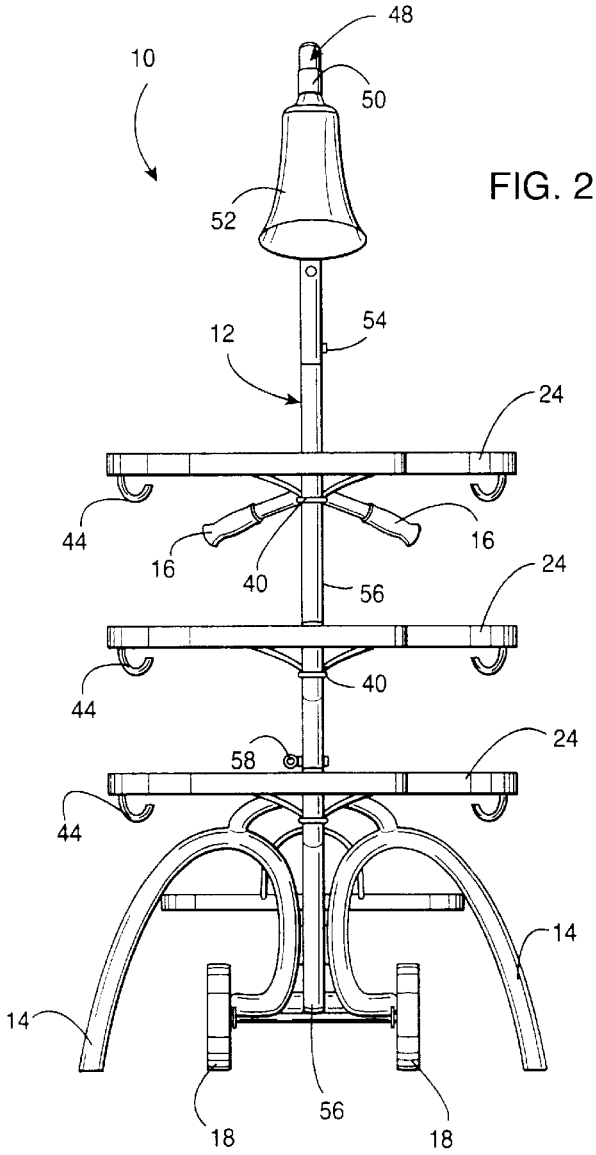
FIG. 2 is a front elevational view of the assembly of FIG. 1.
Figure 3:
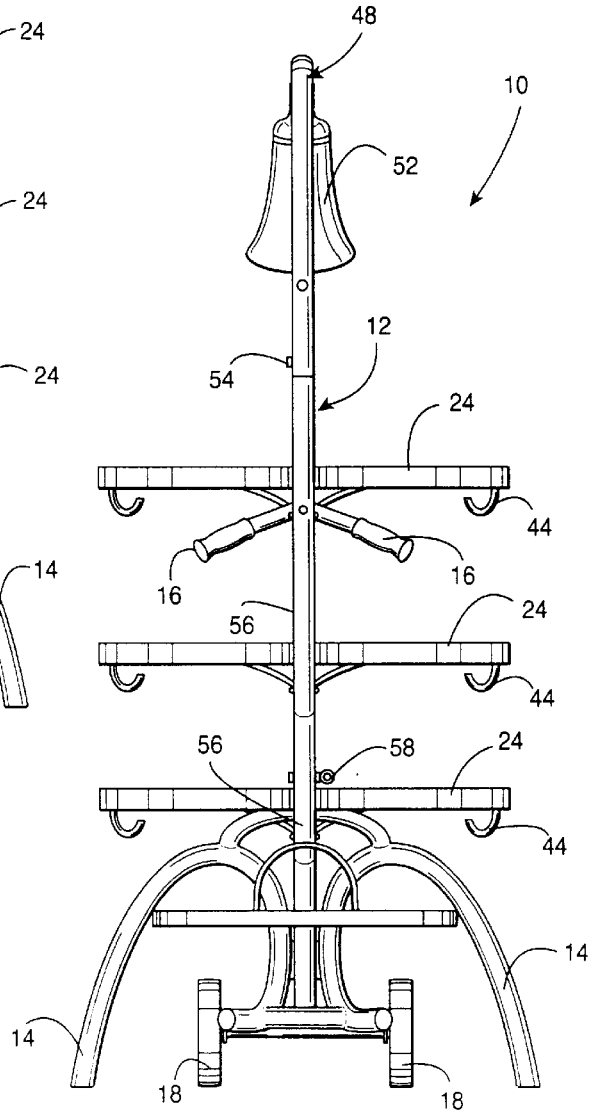
FIG. 3 is a rear elevational view of the assembly of FIG. 1.

With reference to FIGS. 1–3, the assembly 10 includes two prongs 14, preferably of tubing matching that of the frame 12, which extend from a lower portion of the frame 12 to create a three-point base which supports the assembly 10 when resting. Although these prongs 14 can act as handles which can be grasped by the user to move the assembly 10, much like a wheelbarrow, in the preferred embodiment, handles 16 extend from the frame 12 at a position which can be easily grasped by a user.

Figure 7:
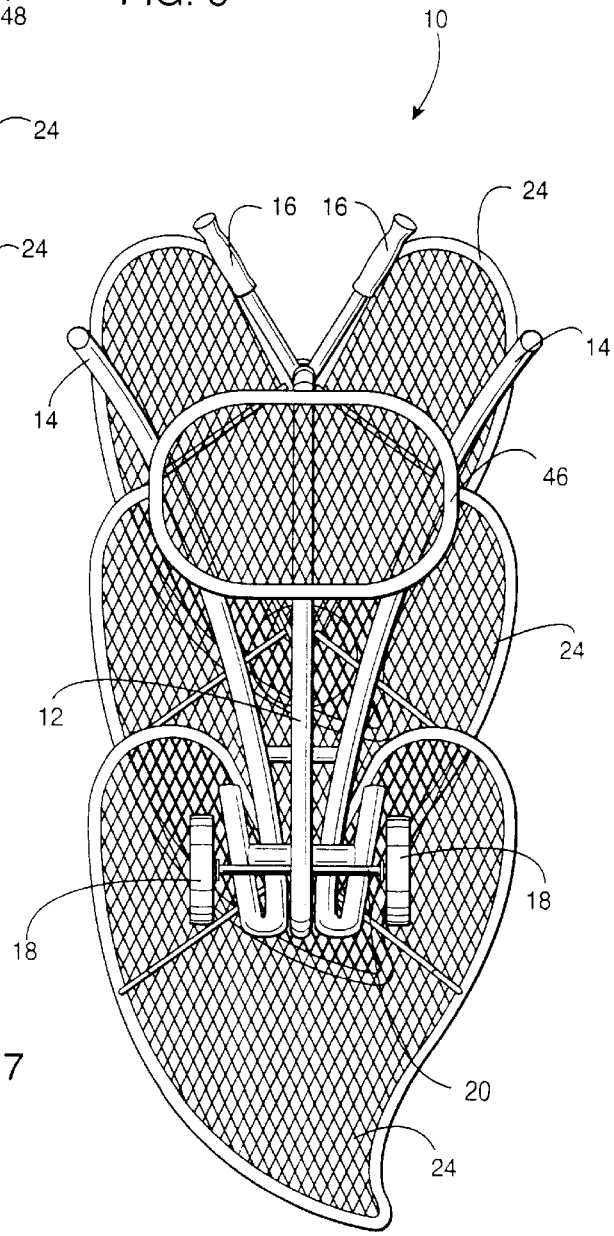
FIG. 7 is a bottom view of the assembly of FIG. 1.

Two or more wheels 18 are attached to the frame 14 so as to make the assembly 10 mobile. The wheels 18 are operably attached to the frame 12 by inserting a bolt 20 through the lower end of the frame 12, as viewed in FIG. 7, which acts as an axle. The wheels 18 are placed on the bolt 20, and nuts 22 are threaded on the bolt 20 and tightened sufficiently to allow rotation of the wheels 18 about the bolt 20.

A plurality of shelves 24 are connected to the frame 12 along the length thereof so as to be spaced from one another. Preferably, the shelves 24 have a lotus leaf-like shape, as shown in the various figures and particularly FIGS. 12–15, to give the assembly 10 an overall look of a plant, and create a visual extension of the supporting plants. Even when not used for displaying plants, the assembly 10 so designed has enormous aesthetic appeal enabling it to be used indoors, as well as outdoors. The shelves 24 provide not only a surface on which to support potted plants, or food or the like, but also provide a working surface for the user.

Figure 13:
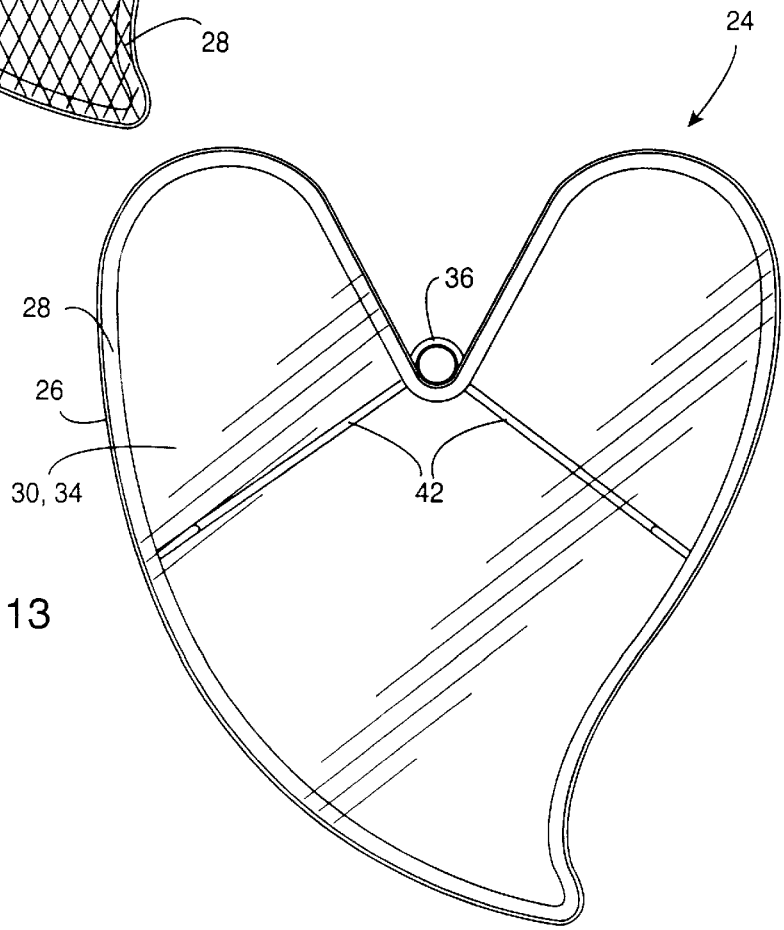
FIG. 13 is a top plan view of another shelf used in accordance with the present invention, and having a transparent base and a lotus leaf design.
Figure 14:
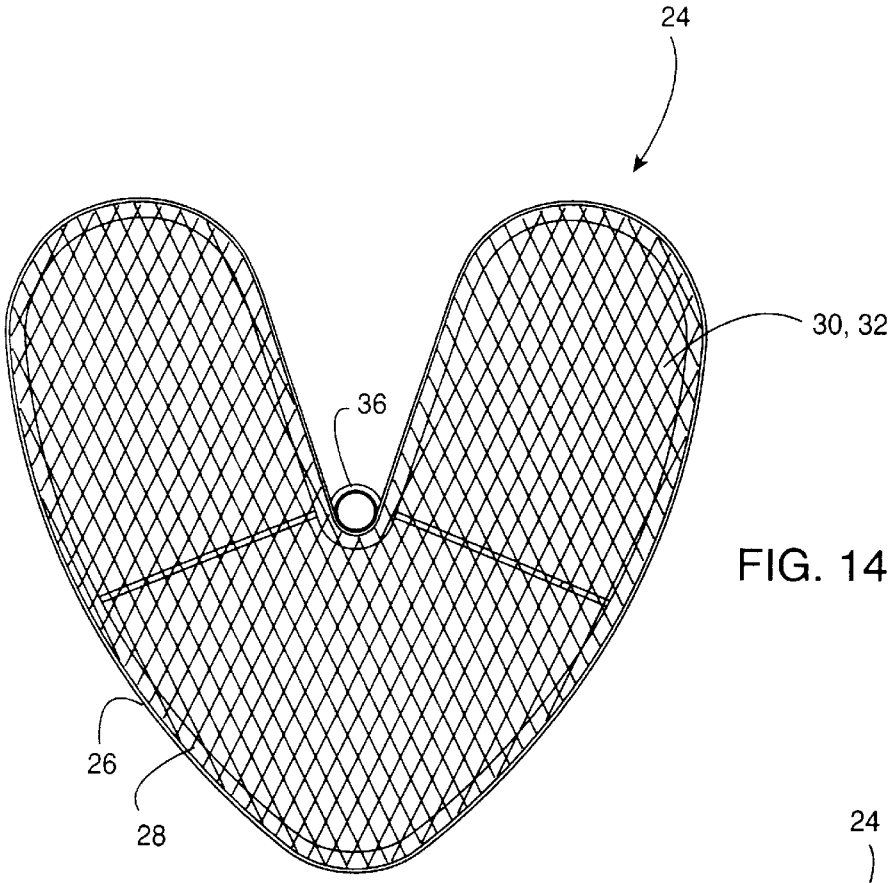
FIG. 14. is a top plan view of yet another shelf having a mesh based used in accordance present invention.
Figure 15:
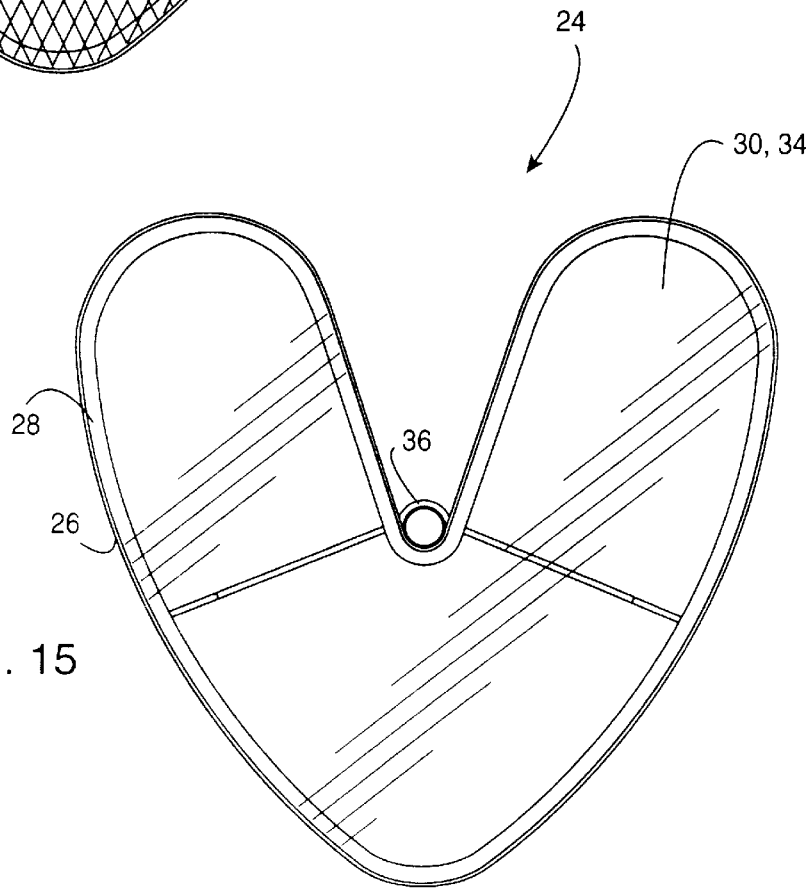
FIG. 15 is a top plan view of another shelf used in accordance with the present invention and having a transparent base.

An outer periphery of the shelves 24 are defined by an outer frame wall 26. The wall 26 can be comprised of rigid wire or the like, but is typically comprised of a metal strip having a lip at a base thereof which extends into the walled area of the shelf 24. This lip 28 is used to support a base 30 upon which the items in question, such as the potted plants, are supported. When the assembly 10 is used to hold and display plants, it is preferred that this base 30 comprise a spread or expanded steel mesh sheeting 32, as illustrated in FIGS. 1, 6, 7, 12 and 14. The mesh sheeting 32 allows water and debris from the plants to fall therethrough, which is particularly useful when the assembly 10 is placed outdoors. Such mesh sheeting 32 is also easily cleaned and maintained. Preferably, a urethane powder-coat is baked on to the surface of the shelves 24 to provide a long lasting, durable, colorful and pleasing finish. It is to be understood, however, that the base 30 of the shelves 24 can be comprised of other materials as well. As illustrated in FIGS. 13 and 15, a clear or translucent base 34 can be inserted within the frame wall 26 of the shelves 24 in order to provide a supportive base 30 while remaining aesthetically pleasing.

Figure 11:
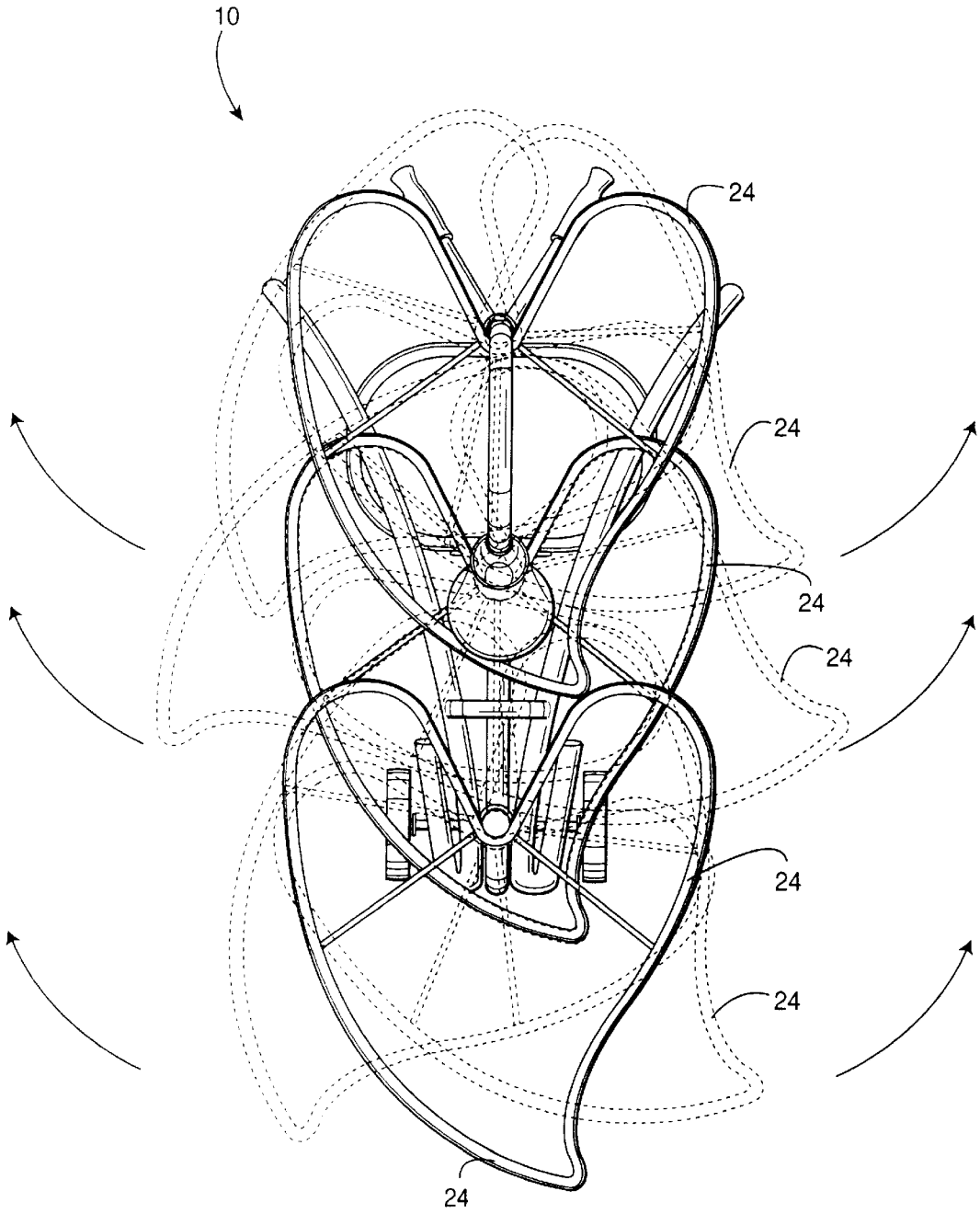
FIG. 11 is another top view of the assembly of FIG. 8, illustrating shelves of the assembly swiveling between positions.
Figure 12:
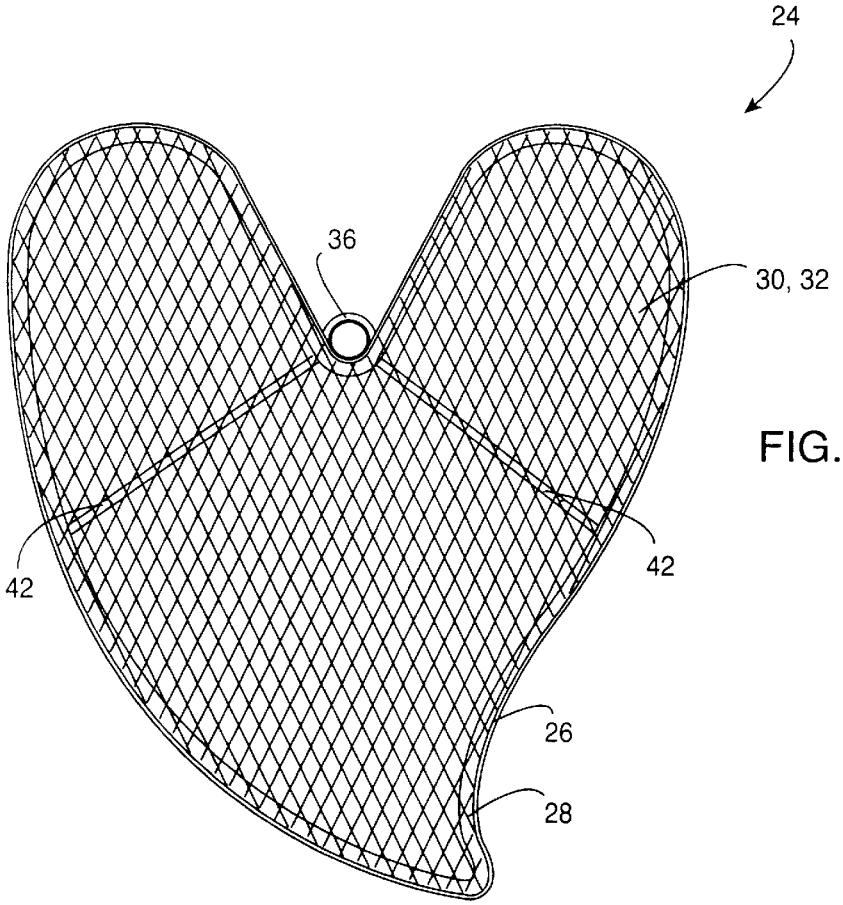
FIG. 12 is a top plan view of a shelf of the present invention having a mesh base and a lotus leaf design.

The shelves 24 are preferably attached to the frame 12 by fitting a collar of the shelves 24 over post 38 which extend vertically from the frame 12. The posts 38 have rings 40 adjacent the base thereof which act as a stop for the collars 36. The shelves 24 can be swivelled and rotated about the posts 38 so as to alter the arrangement of the shelves 24 and supported plants as illustrated in FIG. 11. Preferably, the shelves 24 are of varying sizes to enhance the overall aesthetic appeal of the assembly 10.

Figure 8:
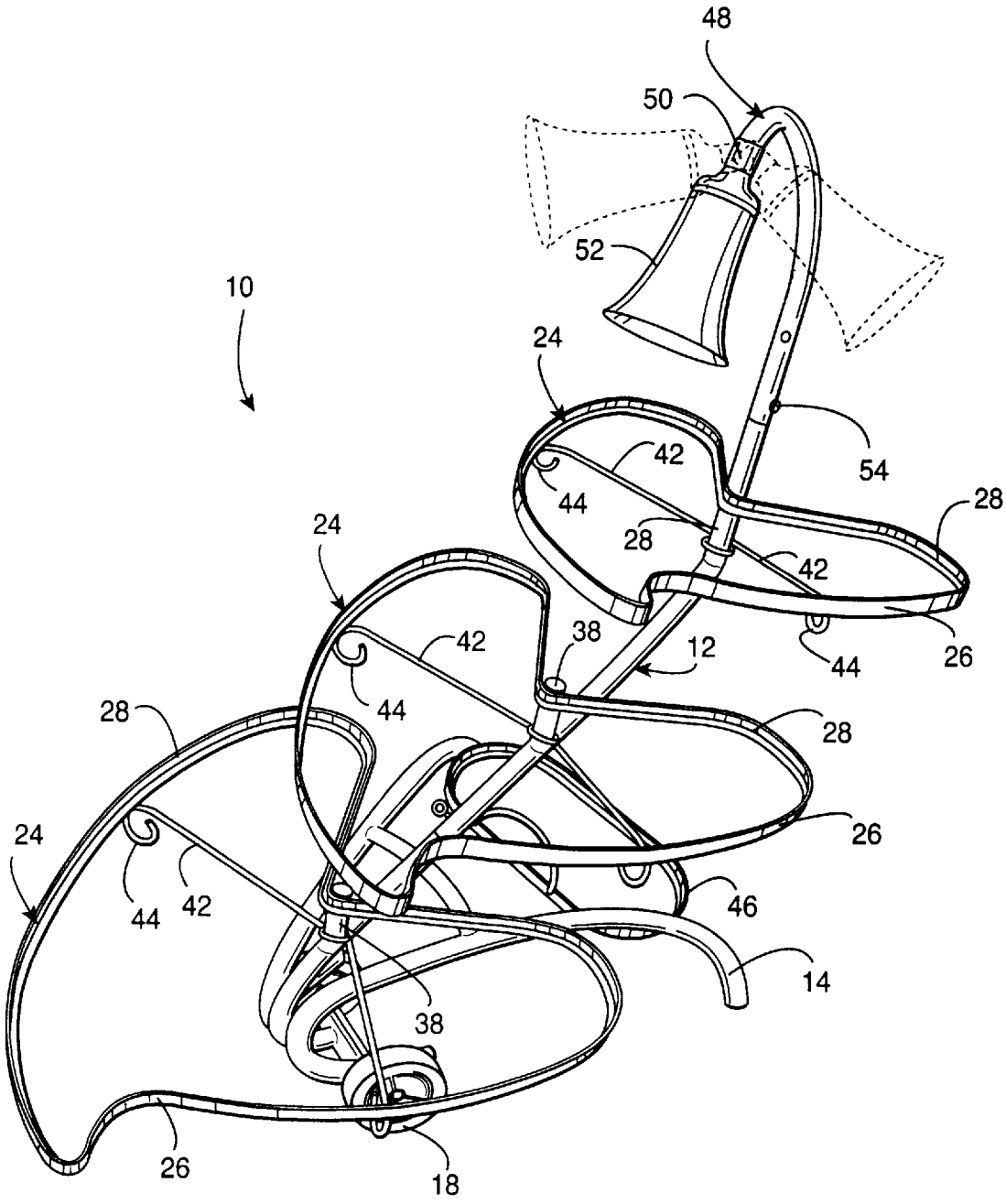
FIG. 8 is a perspective view of another portable display assembly of the present invention, illustrating a pivoting lamp attached thereto.
Figure 9:
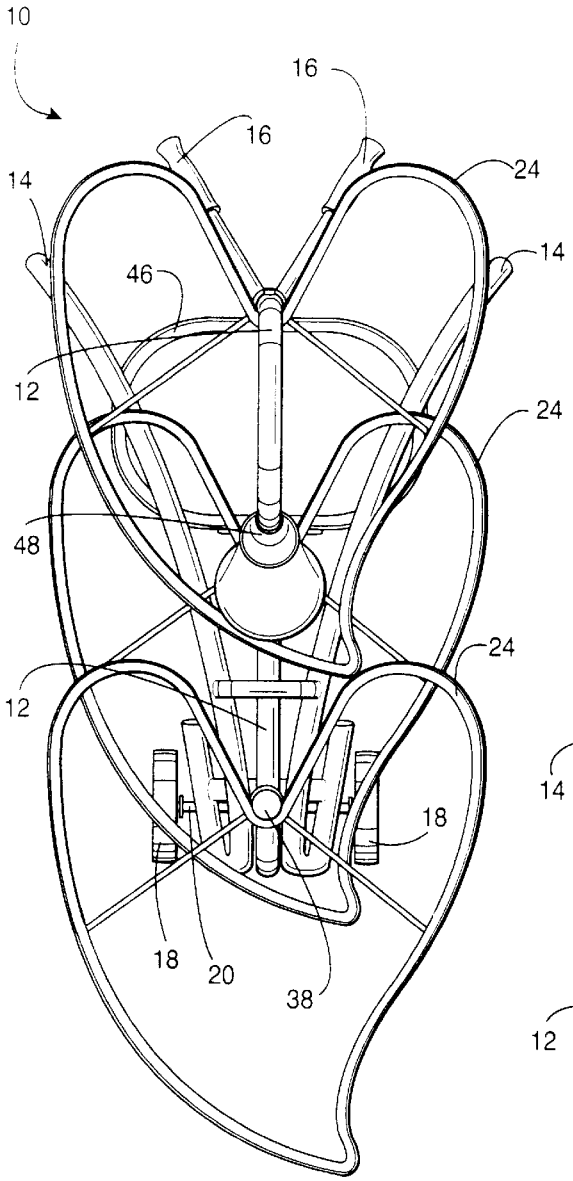
FIG. 9 is a top view of the assembly of FIG. 8.
Figure 10:
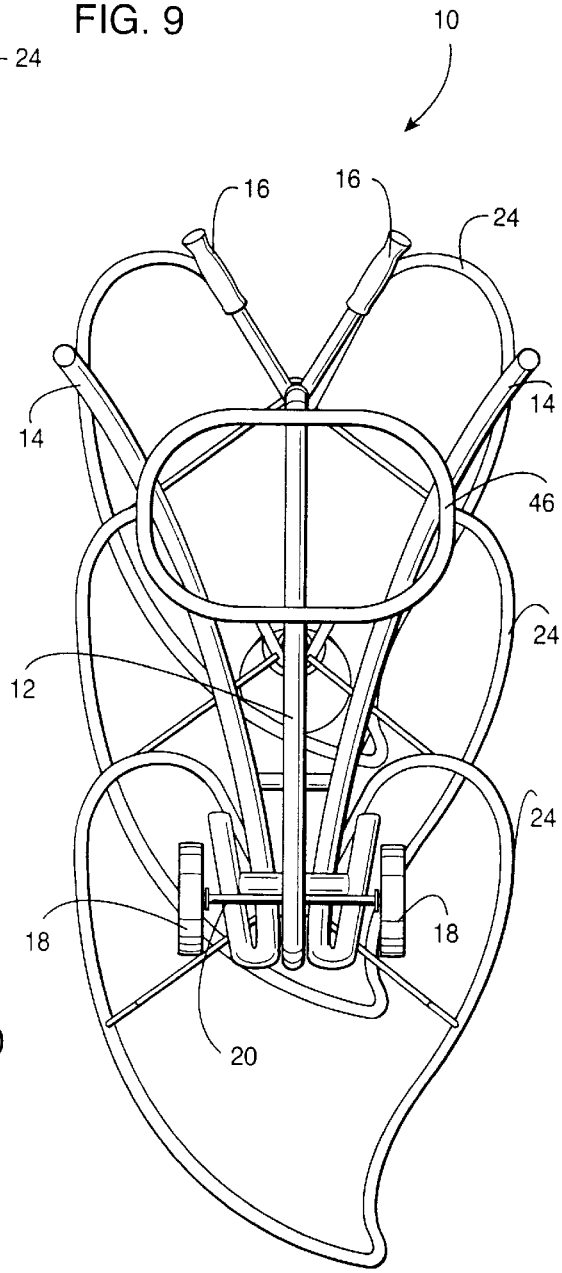
FIG. 10 is a bottom view of the assembly of FIG. 8.

The shelves 24 can include braces 42 which extend from the collar 36 to provide additional weight bearing support for the shelf 24. Hooks 44 extend from the base of the shelves 24, often as an extension of the braces 42 as illustrated in FIGS. 2, 3 and 8, and can be used to support hanging articles such as hanging potted plants, utensils, etc.

In order to maximize space, a shelf 46, preferably of rounded or elliptical design, is attached between prongs 14. Typically, the shelf 46 is permanently attached to the prongs 14 by welding or the like. This shelf 46 also includes the wall 26 and base 30, as described above.

Extending from a top portion of the frame 12 is a lamp fixture 48. The lamp 48 preferably includes a pivoting joint 50 or flexion tubing to permit the lamp 48 to be pivoted over any given area of the assembly 10, or focused directly on a shelf 24, as illustrated in FIG. 8. The lamp 48 can include a specialized bulb to promote plant growth, and directed to a particular shelf 24 to concentrate light on a particular plant. Alternatively, the lamp 48 can include a standard incandescent bulb or infrared heating lamp. The lamp 48 may include a lamp shade 52 which is shaped as a flower or otherwise decorated to fit the overall look and decor of the assembly 10. Typically, the assembly will include an electrical cord (not shown) having a three-prong plug which is insertable into a typical light socket.

The assembly 10 is preferably designed such that it is modular and can be broken down to facilitate transportation, or be conveniently stored when not in use. In this regard, the shelves 24 are removable from the post 38 of the frame 12, as described above. The lamp 48 is attached to the upper end of the frame 12 by a bolt or pin 54 so as to be removably attached to the frame 12. The lamp 48 may, alternatively, be pivotally attached to the frame 12 to permit selected and variable orientations of the lamp relative to the frame to be selected. The frame 12 itself is comprised of two or more segments 56 which are attachable to one another, typically by fitting one end of a frame segment onto a smaller end of an adjoining frame segment 56. The frame segments 56 are securely attached to one another with a bolt or pin 58, as illustrated in FIGS. 2 and 3. As discussed above, the wheels 18 can be removed from the assembly 10 by removing the wheels 18 and nuts 22 from bolt 20.

The assembly 10 of the present invention provides many benefits over the prior art. The assembly 10 is very ornate and aesthetically pleasing to the eye. However, the assembly 10 is also extremely functional in that it can be moved easily from one location to another, such as moving plants from indoors to outdoors for additional sun exposure. The shelves 24 can be swivelled and placed into a desirable arrangement. The pivoting lamp 48 allows areas of the assembly 10 to be highlighted, so as to direct light onto a particular plant or highlight or heat food items when used as a catering cart.

Although several embodiments have been described in detail for purposes of illustration, various modifications may be made without departing from the scope and spirit of the invention. Accordingly, the invention is not to be limited, except as by the appended claims.

What is claimed is:

1. A portable display assembly, comprising:

an elongated and curved frame extending upwardly at an angle less than vertical from a lower end thereof;

a three-point base comprised of a pair of wheels operably disposed on an axle attached to the lower end of the frame, and two prongs extending rearwardly from the lower end of the frame to free ends that contact a supporting surface when the display assembly is resting; and a plurality of shelves connected to the frame along a length thereof so as to be in tiered relationship to one another;

wherein upon lifting the handles, the free ends of the prongs are lifted from the supporting surface and the display assembly can be rolled to a desired location.

2. The assembly of claim 1, wherein the frame is comprised of tubing having a generally S-shaped configuration.

3. The assembly of claim 1, wherein the shelves are of varying sizes.

4. The assembly of claim 1, wherein the shelves include a mesh base.

5. The assembly of claim 1, wherein the shelves include hooks configured to support hanging articles.

6. The assembly of claim 1, wherein the shelves are configured in an ornamental lotus leaf design.

7. The assembly of claim 1, wherein the shelves are removably connected to the frame.

8. The assembly of claim 1, wherein the shelves are connected to the frame such that they are capable of being selectively swivelled.

9. The assembly of claim 1, including a lamp extending from the frame.

10. The assembly of claim 9, wherein the lamp is removably attached to an upper end of the frame.

11. The assembly of claim 9, wherein the lamp includes a pivoting section to enable the lamp to be selectively directed over portions of the assembly.

12. The assembly of claim 1, wherein the assembly comprises interconnecting modular segments connected to one another.

13. A portable display assembly, comprising:

an elongated and curved frame extending upwardly at an angle less than vertical from a lower end thereof;

a three-point base comprised of a pair of wheels operably disposed on an axle attached to the lower end of the frame, and two prongs extending rearwardly from the lower end of the frame to free ends that contact a supporting surface when the display assembly is resting;

a plurality of shelves connected to the frame along a length thereof so as to be in tiered relationship to one another, the shelves being connected to the frame such that they are capable of being selectively swivelled; and a lamp extending from an upper end of the frame, and having a pivoting section to enable the lamp to be selectively directed over portion of the assembly;

wherein upon lifting the handles, the free ends of the prongs are lifted from the supporting surface and the display assembly can be rolled to a desired location.

14. The assembly of claim 13, wherein the shelves are removably connected to the frame.

15. The assembly of claim 14, wherein the shelves are of varying sizes.

16. The assembly of claim 15, wherein the shelves include a mesh base.

17. The assembly of claim 16, wherein the shelves include hooks configured to support hanging articles.

18. The assembly of claim 17, wherein the shelves are configured in an ornamental lotus leaf design.

19. The assembly of claim 13, wherein the lamp is removably attached to an upper end of the frame.

20. The assembly of claim 13, wherein the assembly comprises interconnecting modular segments connected to one another.

21. A portable display assembly, comprising:

an elongated and curved frame having a generally S-shaped configuration extending upwardly at an angle less than vertical from a lower end thereof;

a three-point base comprised of a pair of wheels operably disposed on an axle attached to the lower end of the frame, and two prongs extending rearwardly from the lower end of the frame to free ends that contact a supporting surface when the display assembly is resting;

a plurality of shelves of varying sizes removably connected to the frame along a length thereof so as to be in tiered relationship to one another with the smallest shelf positioned adjacent to an upper end of the frame, and the largest shelf positioned adjacent to the lower end of the frame, the shelves being connected to the frame such that they are capable of being selectively swivelled; and a lamp removably attached to an upper end of the frame, and having a pivoting section to enable the lamp to be selectively directed over the shelves;

wherein upon lifting the handles, the free ends of the prongs are lifted from the supporting surface and the display assembly can be rolled to a desired location.

22. The assembly of claim 20, wherein the shelves include a mesh base.

23. The assembly of claim 22, wherein the shelves include hooks configured to support hanging articles.

24. The assembly of claim 23, wherein the shelves are configured in an ornamental lotus leaf design.

* * * * *